United States Patent [19]

Olson

[11] 4,078,902

[45] Mar. 14, 1978

[54] COKE BRIQUETTE

[75] Inventor: Charles W. Olson, Saginaw, Mich.

[73] Assignee: Acme Sales Corporation, Saginaw, Mich.

[21] Appl. No.: 661,653

[22] Filed: Feb. 26, 1976

[51] Int. Cl.[2] ..... C10L 5/00; C10L 5/12

[52] U.S. Cl. ..... 44/10 C; 44/10 E; 44/16 A

[58] Field of Search ..... 44/1 A, 1 F, 10 R, 10 C, 44/10 E, 16 A; 75/42

[56] References Cited

U.S. PATENT DOCUMENTS

| | | | |
|---|---|---|---|
| 2,473,987 | 6/1949 | Brandon | 75/42 X |
| 2,801,913 | 8/1957 | Becker | 75/42 X |
| 3,356,469 | 12/1967 | Stephenson et al. | 44/10 R |
| 3,762,886 | 10/1973 | Triska | 44/10 E |

*Primary Examiner*—Carl F. Dees

*Attorney, Agent, or Firm*—Learman & McCulloch

[57] ABSTRACT

A coke briquette for use in iron foundries in which coke fines screened from coke being fed to the cupola are recycled into briquette form to be used in place of raw coke in the iron making process. A mix for making the briquettes employs an 80-10-10 percentage by weight ratio of coke fines, high early cement and fly ash respectively to which water is added in a two-step process. The fines have their external surfaces prewetted prior to the adding of the fly ash, cement and additional water for activating the cement. The resulting mix is then formed and cured into cylindrical briquettes by conventional block-making apparatus.

10 Claims, No Drawings

COKE BRIQUETTE

BACKGROUND OF THE INVENTION

Coke employed in the iron making process is required in such large quantities that it must be handled in bulk. The bulk handling methods employed are such that the relatively brittle chunks of coke break up to product a substantial quantity of fines or particles which are too small to be fed into the cupola. Coke particles below a minimum size simply tend to be blown up through the cupola stack, and hence it is conventional practice during the feeding of the coke to the cupola to subject the coke to a screening process which separates the fines out of the coke before they are fed into the cupola.

Typically, the fines thus separated represent about 10 percent of the total amount of the coke fed to the cupola. Normally, the separated fines are subjected to a second screening operation which separates the powdery material from the larger fines. The larger fines recovered from this screening process can usually be sold at a price of about 60 percent of the price of raw coke, while there is very little demand for the remainder. In a typical screening operation coke pieces smaller than 3 inches are separated out of the coke being fed to the cupola, while the secondary screening operation separates particles under ¾ of an inch from the fines.

The present invention is directed to employing the smaller fines in briquette form for use in the iron making process as a substitute for raw coke.

While briquettes of ferrosilicate or other additives have been employed in foundries, such briquettes are used in relatively small quantities and are conventionally hand fed into the cupola. Attempts in the past to provide coke in briquette form have been made, but have been found to be unsatisfactory. The most common problem encountered in previous coke briquetting attempts has been that the briquettes themselves are too brittle to withstand bulk handling and crumble or break up into fines, thus again contributing to the problem which they are attempting to solve. Where sufficient binder has been employed in prior briquettes to satisfy the brittleness or crumbling problems, the amount of binder employed is so high that it creates an unsatisfactorily high amount of slag within the cupola.

A briquette according to the present invention has been found to possess ample resistance to crumbling or fracturing during bulk handling operations and, in addition, contributes to the iron making process by functioning as a flux so that reduced quantities of limestone, a conventional fluxing agent, can be employed with the briquettes are used.

GENERAL DESCRIPTION

A briquette according to the invention comprises coke particles of various sizes bonded together at their surfaces by a cementitious material, the pores of the coke particles being substantially free of the bonding material. A mixture for forming briquettes according to the present invention includes, apart from water and a wetting agent, 80 percent by weight of coke fines, and a water activated cementitious material such as 10 percent by weight of high early Portland cement and 10 percent by weight of fly ash.

The coke fines employed in the present operation are those rejected by a foundry and in general usually will be made up of coke particles of various sizes from powder-like particles up to particles normally of 1¼ inch.

Larger particles can be used advantageously up to a maximum size of about 3 inches. However, the larger sizes have a greater commercial value and economic considierations sometimes dictate the maximum size of particles employed. A generally even distribution of sizes of coke within a given batch is desired to achieve a fairly solid briquette with the smaller particles filling substantially all of the spaces between the larger particles, and with a fairly substantial portion of the larger particles. These larger particles appear to contribute substantially more carbon proportionately to the iron than do the smaller particles, but a briquette made up of entirely larger particles will inherently have a larger volume of voids which makes the briquette more susceptible to fracturing.

Conventional machinery employed in concrete block making is employed in making the briquettes. A conventional industrial-type concrete mixer is employed such as a 70 cu. foot spiral blade mixer such as sold by Besser Company of Alpena, Michigan. This mixer has a capacity of 3000 to 3500 pounds of material of the type here employed.

With the 70 cu. foot Besser mixer described above, a typical example of making coke briquettes in accordance with the present invention employs the following ingredients:

- 2520 pounds of coke fines (8 parts by weight)
- 315 pounds of high early Portland Cement (1 part by weight)
- 315 pounds fly ash (1 part by weight)
- Approx. 1 pound of a suitable wetting agent or plasticizer
- From 30 – 60 gallons of water As previously stated, it is desired that the coke fines include a generally balanced mixture of larger and smaller particles so that within a given briquette there will be a sufficient number of larger particles (to proportionately increase the amount of carbon) combined with a sufficient amount of smaller particles to fill in the spaces between the larger particles to increase the binding action.

Raw coke normally has a carbon content of 90 percent, while coke particles of sizes less than ¼ inch normally have a carbon content of approximately 80 percent. With the foregoing mixture, if all fines employed were of less than 174 inch, the carbon content of the resultant briquette would be 80 percent (percentage of carbon) times 80 percent (by weight of cokd fines) or 64 percent carbon. By employing fines larger than ¼ inch in the mixture, carbon content of briquettes produced by the process of this application has been analyzed at 66 percent to 70.5 percent when the maximum size of fines is ¾ inch, while when fines of up to 2½ to 3 inches are used, the carbon content approaches the theoretical maximum of 72 percent (80 percent coke fines of 90 percent carbon content). Thus while the smaller fines are desirable for the purposes of filling the voids between the larger fines, a high proportion of smaller fines can noticeably decrease the carbon content of the briquette.

The initial step of the process comprises introducing the coke fines into the mixer while the mixer is in operation. The larger and smaller fines thus become intermixed.

At this time, a prewetting or moisturizing step is performed by spraying the fines in the mixer with water.

The amount of water added in the prewetting step exerts a substantial influence on the properties of the resulting briquette and, under normal conditions, approximately 20 gallons of water will be sprayed onto the coke fines within the mixer at a rate of about 10 gallons per minute.

Because of the large volume of coke fines required for commercial production of briquettes, the fines are customarily stored out of doors directly exposed to weather. Thus, at the time the fines are fed into the mixer, their moisture content prior to the prewetting operation can vary considerably, depending upon the weather conditions to which they have been exposed. Experience has shown that where a given quantity of fines has been exposed to extended hot and dry weather conditions prior to their introduction into the mixer, up to 25 gallons of water may be required in the prewetting step, whereas if the same quantity of fines in storage has been exposed to substantial amounts of rain or snow, as little as 15 gallons of water may be used in the prewetting step. The range of 15 – 25 gallons of water in the prewetting step is believed to represent the practical maximum range of variation.

The objective in the prewetting step is to moisten or wet all of the external surfaces of the coke fines without causing any substantial absorption of water into the pores or internal voids of the individual particles. A reasonably accurate estimate of the desired degree of wetness can be obtained by removing a small scoopful of fines from the mixer following the moisturizing step and observing if any substantial amount of water appears to run off from the fines. If any appreciable run-off occurs, it is an indication that the fines are too wet in the sense that the pores of the fines contain water. The amount of water added to the fines in the prewetting stage thus should be reduced. On the other hand, if there is no run-off of water, the sample fines should be examined to ascertain if all their surfaces are moist. If not, additional water should be added to the prewetting stage.

The most practical test found to date is to run an initial trial batch and observe the appearance of the green briquette as it comes out of the block-forming machine. Satisfactory briquettes in their green state fresh from the forming machine are overly wet as compared to a fresh green concrete block, the desired appearance of the green briquette surface being that of a slick gummy sheen which will smear easily if wiped with a finger. This degree of wetness is undesirable in concrete block since it is wet enough so that the block will tend to slump, destroying its squareness and flatness. The external dimensions of the briquettes are not at all critical and some slumping is unobjectionable.

Without this particular degree of wetness, insufficient binding strength results. The amount of prewet water will be increased or decreased depending upon the relative state of wetness of the fresh green briquette. Normally only a small adjustment from the 20 gallon normal prewet will be required.

Following the prewetting step, the cementitious material comprising the fly ash, cement, and wetting agent are introduced into the mixer to coat the fines. The moisture on the surface of the fines will cause the cementitious material to adhere to the surface of the fines and the cementitious material will absorb the moisture thus binding the cementitious material to the surfaces of the fines. If the pores of the fines contain no appreciable moisture, as desired, there will be no significant introduction of the cementitious material to the pores.

Immediately after the coating of the fines, from 20 to 25 gallons of water are sprayed into the mixer to activate the cement and bring the mixture to an over-all wetness somewhat higher than the degree of wetness conventionally employed in concrete block-making practice.

The mixture is then fed into conventional automated block-making machinery having molds capable of forming the mixture into cylindrical briquettes, typically of about six inches in diameter by eight inches axial dimension. Such a briquette, when cured, will weigh about 7½ – 9¼ pounds. The lighter briquettes are those containing particles at the large end of the size range which tend to leave more void space.

After being removed from the block-making machine, the briquettes are transferred to a kiln to be cured. The briquettes are allowed to sit at ambient temperature within the kiln for a minimum of one hour before any heat or moisture is introduced into the kiln. The briquettes may remain in the kiln for longer periods of time before the introduction of heat or moisture, but a one hour minimum waiting period improves the characteristics of the resulting product.

The briquettes are then steamed for a period of five hours, during which time the temperature within the kiln will rise to approximately 180°, resulting in considerable moisture.

After steaming for five hours, the steam is shut off, and the briquettes are allowed to sit in the closed kiln for an additional 5 hours at least, and preferably 10 to 12 hours. The curing process continues as the kiln slowly cools. The kiln is then opened and exhaust fans remove any remaining heat or moisture.

Briquettes produced according to the process described above have been found to possess resistance to crumbling or fracturing equal to or better than that of raw coke handled under the same conditions. A large foundry which is currently using over 1,000 tons of these briquettes per month has found that the amount of slag produced by the briquettes to be well within acceptable limits although the past experience of this foundry has been that undesirable amounts of slag were produced from other briquettes when the amount of binder (cement and fly ash) exceeded 10 percent by weight of the briquette. The unexpectedly low amount of slag production by the briquette of the present invention is believed due to the fact that the binder material in the briquette produced by the process described above is substantially entirely located on the external surfaces of the coke particles. Because, in the prewetting step, no substantial amount of water soaks to the internal voids in the particles, the cement and fly ash when introduced into the mixture adhere to the external surfaces and are not attracted by water into the voids. Cement and fly ash which follow water into internal voids within the coke cannot contribute to the binding action. Because of the exposed position of the binder on the exterior of the coke particles the binder can easily pass directly into the melt. The cement portion of the binder is thus apparently able to contribute a fluxing action to the melt to reduce slag formation.

Experience has shown that briquettes produced by this process have a compression strength of 1100 – 1800 p.s.i. and can be handled in the foundry in the same manner as coke with very little chipping or crumbling, most of which occurs at the corners. During conventional handling, the briquettes may be dropped six or more times from heights of 3 to 20 feet. The lower end of the compressive strength range has been found to be adequate in the face of normal bulk handling. Briquettes made from coke particles at the large end of the size range tend to have the lower compressive strength because of the relatively larger number of voids in the formed briquette.

It has been found that after repeated drops or intentional fracturing, the briquette does not crumble, but tends to break into relatively large pieces of a size acceptable to the cupola.

While one example of the invention has been described in detail, it will be apparent to those skilled in the art that the example described may be modified. Therefore, the foregoing description is to be considered exemplary rather than limiting, and the true scope of the invention is that defined in the following claims.

What is claimed is:

1. The method of making a coke briquette for use in an iron foundry comprising the steps of feeding into an operating mixer a charge of approximately 8 parts by weight coke fines of a variety of sizes equal to or less than 3 inches, spraying the coke fines in the mixer with water to prewet the fines until the external surfaces of the fines are thoroughly wetted and terminating the spraying of the fines before any substantial amount of water has soaked into the internal voids of the fines, adding to and mixing with the wetted fines approximately 1 part by weight of high early cement and approximately 1 part by weight of fly ash, and adding to the mixed fines, cement and fly ash an additional amount of water sufficient to bring the mixture to a degree of wetness wherein a green briquette formed from said mixture by conventional block making apparatus is susceptible to slumping, and forming briquettes from said mixture in a conventional block making apparatus.

2. The method of claim 1 wherein 1 part by weight equals 315 pounds, and the amount of water sprayed on said fines in the prewet step is between 15 and 25 gallons.

3. The method of claim 2 wherein approximately 20 gallons of water is sprayed onto the fines in the prewet step at a rate of about 10 gallons per minute.

4. The method of claim 1 further comprising the steps of exposing the green blocks to ambient temperature for at least an hour subsequent to their formation and then steaming the blocks within a kiln for about 5 hours, and exposing the blocks to ambient temperature for at least 10 hours after the conclusion of the steaming step.

5. A coke briquette produced by the process of claim 1.

6. A method of making a coke briquette from coke particles from a charge of particles of various sizes up to and including 2 inches and larger particles having pores therein, said method comprising moistening said charge of particles with water in an amount sufficient to wet the surfaces of said particles without appreciable absorption of water in said pores; subsequently applying a coating of water activated cementitious binder to the wetted surfaces of said particles; applying additional water to the coated particles to activate the binder; and then molding the particles into a briquette.

7. A coke briquette comprising a plurality of individual coke particles of various sizes of 3 inches or less bound together into a briquette of, each of said particles having an external surface and some of said particles having internal pores, each of said particles having on its external surface a coating of cementitious material, the internal pores of said some of said particles being substantially free of said cementitious material, and said particles being bonded to one another by said cementitious material.

8. A method of forming a coke briquette from various size, discrete particles of coke at least some of which have internal voids, said method comprising moistening said particles with water in an amount insufficient to enable appreciable introduction of water into said voids but sufficient to enable a water activated, curable, cementitious binder to adhere to the external surfaces of said particles; applying a coating of said binder to the external surfaces of said particles; applying to the coated particles additional water in an amount to activate said binder; molding the coated particles into a substantially solid body; and curing said binder to bond said particles to one another.

9. A coke briquette formed according to the method of claim 8.

10. A coke briquette comprising a plurality of discrete, various size coke particles bound together into a substantially solid body, each of said particles having an external surface and at least some of said particles having internal voids, each of said particles having a cementitious binder bonded to its external surface, the internal voids of said some of said particles being substantially free of said binder, and said particles being bound to one another by said binder.

* * * * *

UNITED STATES PATENT AND TRADEMARK OFFICE

CERTIFICATE OF CORRECTION

PATENT NO. : 4,078,902
DATED : March 14, 1978
INVENTOR(S) : Charles W. Olson

It is certified that error appears in the above-identified patent and that said Letters Patent are hereby corrected as shown below:

Column 1, line 51, change "with" to --when--.

Column 2, line 49, change "cokd" to --coke--.

Column 4, line 14, change "9 1/4" to -- 9 1/2--.

Column 6, line 18, cancel "of" (first occurrence).

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*